US010424279B2

(12) United States Patent
Ishii

(10) Patent No.: US 10,424,279 B2
(45) Date of Patent: Sep. 24, 2019

(54) PERFORMANCE APPARATUS, PERFORMANCE METHOD, RECORDING MEDIUM, AND ELECTRONIC MUSICAL INSTRUMENT

(71) Applicant: CASIO COMPUTER CO., LTD., Shibuya-ku, Tokyo (JP)

(72) Inventor: Hironaga Ishii, Kumagaya (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 112 days.

(21) Appl. No.: 15/696,042

(22) Filed: Sep. 5, 2017

(65) Prior Publication Data

US 2018/0247623 A1 Aug. 30, 2018

(30) Foreign Application Priority Data

Sep. 5, 2016 (JP) ..... 2016-172439

(51) Int. Cl.
*G10H 1/00* (2006.01)
*G10H 1/26* (2006.01)

(52) U.S. Cl.
CPC ..... *G10H 1/0008* (2013.01); *G10H 1/0066* (2013.01); *G10H 1/26* (2013.01); *G10H 2210/161* (2013.01); *G10H 2210/341* (2013.01)

(58) Field of Classification Search
CPC ..... G10H 1/0008; G10H 1/0066; G10H 1/26; G10H 2210/161; G10H 2210/341
USPC ..... 84/609
See application file for complete search history.

(56) References Cited

U.S. PATENT DOCUMENTS 4,230,012 A * 10/1980 Bommersbach ..... G09B 15/04 84/648
5,672,837 A * 9/1997 Setoguchi ..... G10H 1/0008 84/609
6,177,624 B1 * 1/2001 Takahashi ..... G10H 1/0008 84/609

(Continued)

FOREIGN PATENT DOCUMENTS

JP 2000056769 A 2/2000
JP 2002169547 A 6/2002
JP 2002196756 A 7/2002

*Primary Examiner* — David S Warren
*Assistant Examiner* — Christina M Schreiber
(74) *Attorney, Agent, or Firm* — Holtz, Holtz & Volek PC

(57) ABSTRACT

The present disclosure provides a performance apparatus capable of changing to a performance pattern making a musically natural transition. A CPU 13 determines which stage a performance pattern of each of tracks Tr (1) to (4) currently selected belongs to, and obtains the number of performance patterns for each stage, in accordance with depression of a transition button. The CPU 13 determines that the stage having the maximum number of performance patterns is the "current stage" among the number of performance patterns for each stage obtained, and changes the performance pattern of each of the tracks Tr (1) to (4) to the stage subsequent to the determined "current stage". Therefore, the performance pattern can be changed into a performance pattern making a musically natural transition. As a result, even a beginner user being poor in music knowledge can set an appropriate performance pattern matching the transition of the song.

10 Claims, 10 Drawing Sheets

(56) References Cited

U.S. PATENT DOCUMENTS

| | | | | |
|---|---|---|---|---|
| 2001/0015123 | A1* | 8/2001 | Nishitani | A63B 71/0686 84/615 |
| 2002/0105359 | A1* | 8/2002 | Shimizu | G10H 7/02 327/1 |
| 2014/0083279 | A1* | 3/2014 | Little | G10H 1/0008 84/609 |
| 2015/0107443 | A1* | 4/2015 | Yasuraoka | G10H 1/18 84/615 |
| 2018/0247623 | A1* | 8/2018 | Ishii | G10H 1/0008 |

* cited by examiner

| | PERFORMANCE PATTERN | | |
|---|---|---|---|
| | STAGE A | STAGE B | STAGE C |
| Tr (1): Drum | Drum A | Drum B | Drum C |
| Tr (2): Bass | Bass A | Bass B | Bass C |
| Tr (3): Synth1 | Synth1 A | Synth1 B | Synth1 C |
| Tr (4): Synth2 | Synth2 A | Synth2 B | Synth2 C |

PERFORMANCE APPARATUS, PERFORMANCE METHOD, RECORDING MEDIUM, AND ELECTRONIC MUSICAL INSTRUMENT

CROSS REFERENCE TO RELATED APPLICATIONS

The present application claims the priority right based on Japanese Patent Application No. 2016-172439 filed on Sep. 5, 2016, and all the contents of the said basic application shall be incorporated into the present application by reference.

BACKGROUND

Technical Field

The present invention relates to a performance apparatus, performance method, a recording medium, and an electronic musical instrument capable of changing to a performance pattern making a musically natural transition.

Related Art

Automatic performance apparatus which is called a sequencer is known. For each of a plurality of tracks corresponding to the performance part (musical instrument part), the automatic performance apparatus stores, in a memory, sequence data representing the tone pitch and sound production timing of each note constituting a song, and sequentially reads and plays back (automatically performs) the sequence data for each track stored in the memory in synchronization with the tempo of the music. As an example of this type of apparatus, for example, JP 2002-169547 A discloses an automatic performance apparatus which makes it possible to play back sequence data in which a drum sound and a non-drum sound are mixed in one track.

By the way, in the field of dance music, rendition style is required to replace the performance pattern of the track in the automatic performance and change the performance pattern of the track of the specified performance part according to "feeling" of the performance by the user. It should be noted that the performance pattern referred to herein means sequence data for a predetermined measure, for example.

By the way, when the user, who is a beginner user being poor in music knowledge, freely selects and changes the performance pattern (sequence data) in the automatic performance, the user is unable to select an appropriate performance pattern that matches the transition of the song, and there is a possibility of changing into a performance pattern making a musically unnatural transition.

The present application provides a performance apparatus, a performance method, a recording medium, and an electronic musical instrument capable of changing to a performance pattern making a musically natural transition.

SUMMARY

A performance apparatus according to one embodiment of the present invention includes: operators that are assigned music data items respectively, wherein the music data items are divided into track groups corresponding to tracks and the music data items are divided into stage groups corresponding to stages, wherein the music data items in each of the track groups are different from each other in stage, and wherein the music data items in each of the stage groups are same in stage; and a processor; wherein the processor executes: play back processing that plays back, based on a user designation, one of the music data items in each of the tracks, wherein the music data items in the tracks are played back at the same time; determination processing that determines a common stage based on current stages of the music data items which are currently played back by the play back processing; and change processing that (1) changes each of the current stages into a next stage of the common stage determined by the determination processing, and (2) changes the music data items played back by the play back processing into the music data items corresponding to the next stage for each of the tracks, and wherein in executing the change processing, if a current stage of at least one of the music data items which are played back by the play back processing is equal to the next stage, the current stage is not changed by the change processing.

BRIEF DESCRIPTION OF DRAWINGS

A more detailed understanding of the present application can be obtained if the following detailed description is considered in conjunction with the following drawings.

DETAILED DESCRIPTION

Hereinafter, one embodiment of the present application will be described with reference to the drawings.

A. Configuration

Figure 1:
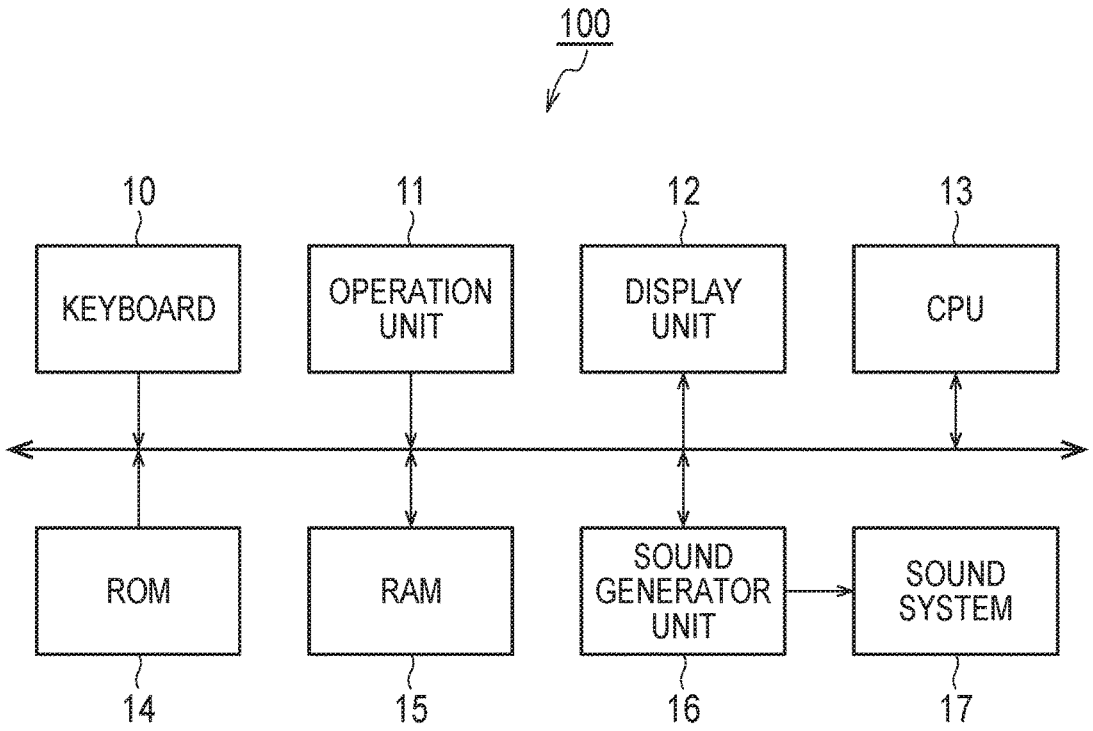
FIG. 1 is a block diagram showing an electrical configuration of an electronic musical instrument 100 according to one embodiment of the present application.

FIG. 1 is a block diagram showing an overall configuration of an electronic musical instrument 100 according to one embodiment of the present application. In this figure, a keyboard 10 generates performance input information composed of a key-on and key-off signal, a key number, a velocity and the like according to performance input operation (depression and release key operation). The performance input information generated by the keyboard 10 is converted into note-on and note-off event in MIDI format by a CPU 13, and then supplied to a sound generator unit 16.

An operation unit 11 includes not only a power switch to turn on and off the apparatus power supply, but also, for example, a song selection switch for selecting a song number of a song automatically performed, a start and stop switch for instructing start and stop of automatic performance, a pattern selection switch for selecting a performance pattern for each track corresponding to each performance part (musical instrument part) automatically performed, a transition button changing a performance pattern of each track currently selected into a performance pattern making a musically natural transition, and the like, and the operation unit 11 generates a switch event of a type corresponding to each of these switch operation and button operation. Various switch events generated by the operation unit 11 are retrieved by the CPU 13.

A display unit 12 is composed of a color liquid crystal display panel, a display driver, and the like, and displays, on the screen, the setting state and operating state of each part of the musical instrument in accordance with a display control signal supplied from the CPU 13. The CPU 13 not only sets the operation state of each part of the apparatus based on various switch events supplied from the operation unit 11 but also instructs the sound generator unit 16 to generate musical tone waveform data based on the performance input information supplied from the keyboard 10, and instructs the sound generator unit 16 to start and stop automatic performance according to the depression operation of the start and stop switch.

When the transition button is pressed while automatic performance is in progress, the CPU 13 changes the performance pattern of each track currently being selected to a performance pattern making a musically natural transition. The characteristic processing operation of the CPU 13 according to the gist of the present application explained above, i.e., the operation of the transition button processing will be described in details later.

Figure 2A:
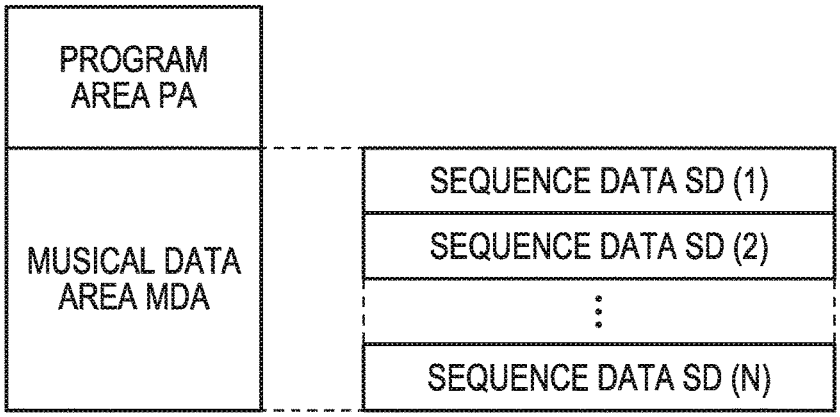
FIG. 2A shows a memory map showing the data structure of a ROM 14.

As shown in FIG. 2A, a ROM 14 includes a program area PA and a song data area MDA. In the program area PA of the ROM 14, various control programs to be loaded into the CPU 13 are stored. The various control programs include transition button processing and pattern change processing which will be described later.

Sequence data SD (1) to SD (N) of a plurality of songs are stored in the song data area MDA of the ROM 14. Among the sequence data SD (1) to SD (N) of these songs, the sequence data SD (n) associated with the song number n of song selected by the above song selection switch operation is used as song data for automatic performance.

Figure 2B:
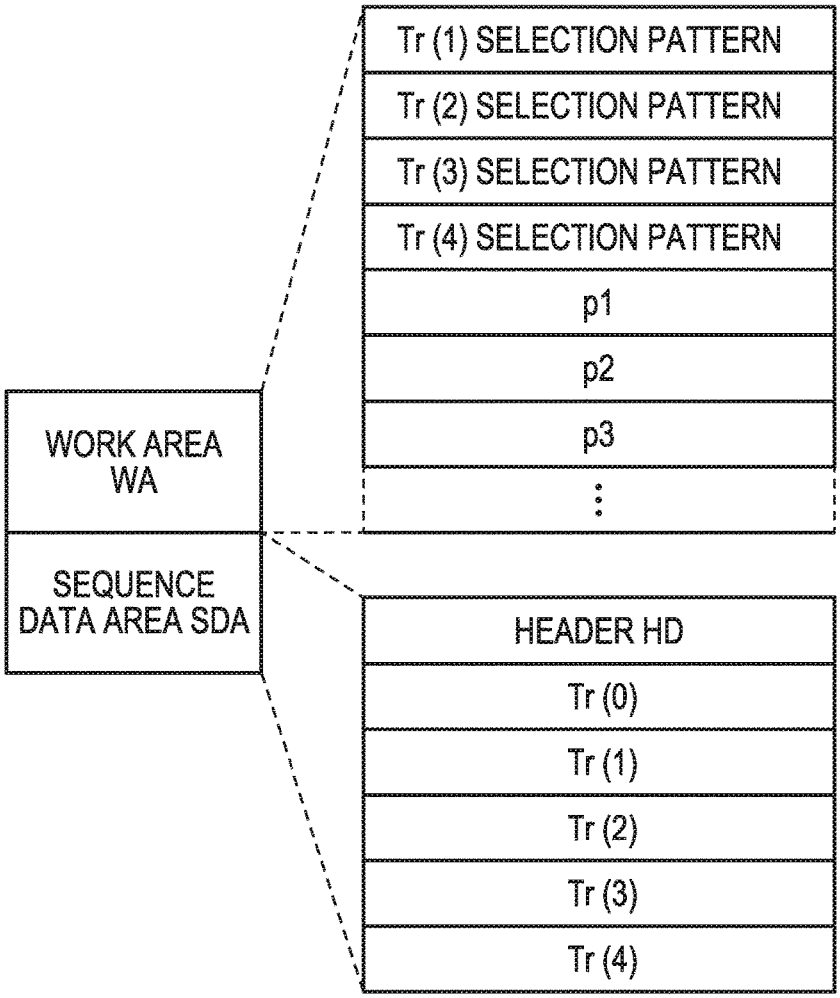
FIG. 2B shows a main register flag data stored in a RAM 15, and a memory map showing a structure of sequence data.

As shown in FIG. 2B, a RAM 15 includes a sequence data area SDA and a work area WA. The sequence data SD (n) of song number n selected by the song selection switch operation is read from the song data area MDA of the ROM 14 and stored in the sequence data area SDA of the RAM 15.

The sequence data SD (n) includes a header HD, a track Tr (0), and tracks Tr (1) to (4). In the header HD, a format indicating a data format and a time base representing a resolution are stored. A song name, a tempo (BPM), a time signature, and the like are stored in the track Tr (0).

Figures 3A, 3B:
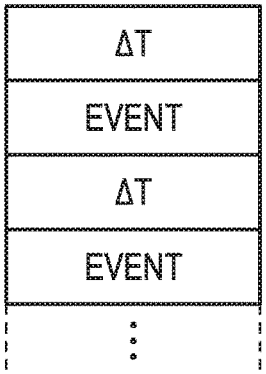
FIG. 3A shows a figure illustrating a transition configuration of a performance pattern in each of the tracks Tr (1) to Tr (4)
FIG. 3B shows a structure of sequence data constituting the performance pattern.

In the present embodiment, as shown in FIG. 3A, Drum (drum part) is assigned to the track Tr (1), Bass (base part) to the track Tr (2), Synth1 (synthesized sound 1 part) to the track Tr (3), and Synth2 (synthesized sound 2 part) to the track Tr (4).

The tracks Tr (1) to (4) associated with these performance parts (musical instrument parts) are composed of a performance pattern forming grooves in the order of musically natural transition, i.e., stage A, stage B, and then stage C. More specifically, the track Tr (1) is composed of, at first, the performance pattern "Drum A" of stage A, subsequently the performance pattern "Drum B" of stage B, and further the performance pattern "Drum C" of stage C. The other tracks Tr (2) to (4) also have performance patterns forming grooves in the order of stage A, stage B, and then stage C.

One performance pattern is constituted by, for example, sequence data SD for a predetermined measure. As shown in FIG. 3B, in the sequence data SD representing each note of the song, a delta time ΔT representing timing of the current event EV by using a difference time from the previous event and an event EV representing a tone to produce sound or a muted tone form a single set, and these sets are addressed in the chronological order corresponding to the progress of the song.

In an example of FIG. 3A, the "Drum A", the "Drum B" and the "Drum C" form a track group, the "Bass A", the "Bass B" and the "Bsss C" form a track group, the "Synth1 A", the "Synth1 B" and the "Synth1 C" form a track group, and the "Synth2 A", the "Synth2 B" and the "Synth2 C" form a track group. In the example of FIG. 3A, there are 4 track groups.

In an example of FIG. 3A, the "Drum A", the "Bass A", "Synth1 A" and the "Synth2 A" form a stage group, the "Drum. B", the "Bass B", "Synth1 B" and the "Synth2 B" form a stage group, and the "Drum C", the "Bass C", "Synth1 C" and the "Synth2 C" form a stage group. In the example of FIG. 3A, there are 3 stage groups.

Various register and flag data used for processing performed by the CPU 13 are temporarily stored in the work area WA of the RAM 15. FIG. 2B shows main register and flag data related to the gist of the present application. In this figure, the Tr (1) selection pattern to the Tr (4) selection pattern temporarily store identifiers representing the currently selected performance patterns in accordance with the pattern selection switch operation performed by the user in the tracks Tr (1) to (4) associated with the performance part (musical instrument part).

The counter p1 counts the number of patterns belonging to the "stage A" of the performance patterns currently being selected from the identifiers temporarily stored in the Tr (1) selection pattern to Tr (4) selection pattern. The counter p2 counts the number of patterns belonging to the "stage B" of the performance patterns currently being selected from the identifiers temporarily stored in the Tr (1) selection pattern to Tr (4) selection pattern. The counter p3 counts the number of patterns belonging to the "stage C" of the performance patterns currently being selected from the identifiers temporarily stored in the Tr (1) selection pattern to Tr (4) selection pattern.

Subsequently, back to FIG. 1, the configuration of the electronic musical instrument 100 will be explained. In FIG. 1, the sound generator unit 16 has a plurality of simultaneous sound production channels which are constituted by a well-known waveform memory reading method, and the sound generator unit 16 not only generates tone waveform data according to the note on and note off event based on the performance input information supplied from the CPU 13 but also generates performance sound data for each track by reproducing the sequence data SD of the tracks Tr (1) to (4) which the CPU 13 reads from the sequence data area SDA of the RAM 15 in accordance with the progress in the automatic performance.

A sound system 17 converts the musical sound data and performance sound data output from the sound generator unit 16 into a musical sound signal and a performance sound signal in an analog format, performs filtering such as removing unnecessary noises from the musical sound signal and the performance sound signal, amplifies the musical sound signal and the performance sound signal, and produces sound from a speaker (not shown).

B. Operation

Subsequently, each operation of transition button processing executed by the CPU 13 and pattern change processing called from the transition button processing will be explained with reference to FIG. 4 to FIG. 6C as the operation of the electronic musical instrument 100 according to the above configuration.

(1) Operation of Transition Button Processing

Figure 4:
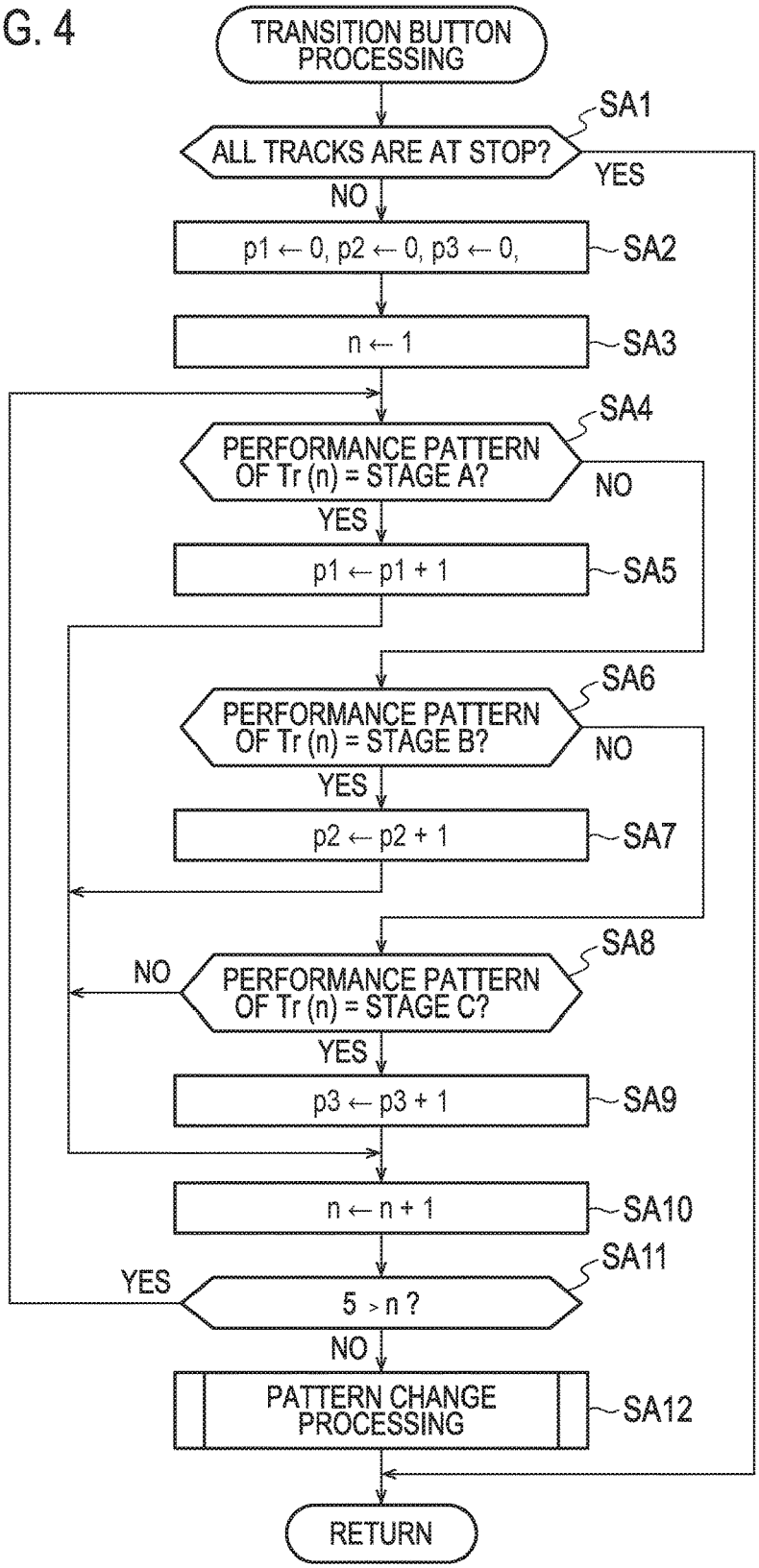
FIG. 4 is a flowchart showing the operation of the transition button processing executed by a CPU 13.

FIG. 4 is a flowchart showing the operation of the transition button processing executed by the CPU 13. When the transition button disposed in the operation unit 11 is pressed by the user in the state where the electronic musical instrument 100 is in the ON state, the CPU 13 executes the transition button processing shown in FIG. 4 according to the operation event, and proceeds to the processing in step SA1.

In step SA1, the CPU 13 determines whether or not all tracks Tr (1) to (4) are at a stop, i.e., whether or not automatic performance is at a stop. If all tracks Tr (1) to (4) are at a stop (the automatic performance is at a stop), the determination result is "YES" and this processing is terminated, but if the automatic performance is not at a stop, the determination result is "NO" and the CPU 13 proceeds to the processing in next step SA2.

In step SA2, the CPU 13 resets each of the counters p1, p2 and p3, as described above, and sets the initial value "1" to the pointer n designating the track in step SA3 subsequent thereto. Then, in step SA4, the CPU 13 determines whether the performance pattern of the track Tr (n) designated by the pointer n belongs to the "stage A" or not. More specifically, the CPU 13 determines whether the identifier temporarily stored in the Tr (1) selection pattern described above is of the performance pattern belonging to the "stage A".

If the performance pattern of the track Tr (n) designated by the pointer n belongs to the "stage A", the determination result is "YES" and the processing in step SA5 is subsequently performed. In step SA5, the CPU 13 increments the counter p1 for counting the number of performance patterns belonging to the "stage A", and thereafter proceeds to the processing in step SA10 described later.

On the other hand, if the performance pattern of track Tr (n) designated by the pointer n does not belong to the "stage A", the determination result of step SA4 is "NO", and the CPU 13 proceeds to the processing in step SA6. In step SA6, the CPU 13 determines whether the performance pattern of the track Tr (n) designated by the pointer n belongs to the "stage B" or not. More specifically, the CPU 13 determines whether the identifier temporarily stored in the Tr (1) selection pattern described above is of the performance pattern belonging to the "stage B".

If the performance pattern of track Tr (n) designated by the pointer n belongs to the "stage B", the determination result is "YES", and the CPU 13 proceeds to step SA7. In step SA7, the CPU 13 increments the counter p2 for counting the number of performance patterns belonging to the "stage B" and proceeds to the processing in step SA10 described later.

In contrast, if the performance pattern of track Tr (n) designated by the pointer n does not belong to the "stage B", the determination result of step SA6 is "NO", and the CPU 13 proceeds to the processing in step SA8. In step SA8, the CPU 13 determines whether or not the performance pattern of the track Tr (n) designated by the pointer n belongs to the "stage C", and more specifically, the CPU 13 determines whether the identifier temporarily stored in the Track (1) selection pattern described above is of the performance pattern belonging to the "stage C".

If the performance pattern of track Tr (n) designated by the pointer n belongs to the "stage C", the determination result is "YES", and the CPU 13 proceeds to step SA9. In step SA9, the CPU 13 increments the counter p3 for counting the number of performance patterns belonging to the "stage C" and proceeds to the processing in next step SA10.

Then, in step SA10, the CPU 13 increments the pointer n, proceeds to step SA11 subsequent thereto, and determines whether the incremented value of the pointer n is smaller than "5" or not. More specifically, the CPU 13 determines whether or not a determination as to which of the "stage A", the "stage B" or the "stage C" the performance patterns of all the tracks Tr (1) to (4) belong to has been made.

When the value of pointer n has not yet reached "5", and a determination as to which of the "stage A", the "stage B" or the "stage C" the performance patterns of all the tracks Tr (1) to (4) belong to has not yet been made, the determination result of step SA11 is "YES", and the CPU 13 returns back to the processing in step SA4 explained above.

Thereafter, until the value of the incremented pointer n reaches "5", the CPU 13 repeatedly executes steps SA4 to SA11 explained above, and the CPU 13 determines which of the "stage A", the "stage B" or the "stage C" the performance pattern of the track Tr (n) designated by the incremented pointer n belongs to.

The CPU 13 has finished determining which of the "stage A", the "stage B" or the "stage C" the performance patterns of all the tracks Tr (1) to (4) belong to, the number of performance patterns belonging to the "stage A" is stored in the counter p1; the number of performance patterns belonging to the "stage B" is stored in the counter p2, and the number of performance patterns belonging to the "stage C" is stored in the counter p3. Then, when the value of the incremented pointer n reaches "5", the determination result of step SA11 is "NO", the CPU 13 executes the pattern change processing via step SA12.

Hereinafter, an example of an operation of the steps SA4 to SA11 explained above will be described based on the example shown in FIGS. 6A to 6C. For example, the performance pattern currently selected in each of the tracks Tr (1) to (4) is considered to be the combination shown in FIG. 6A before pressing the transition button. Then, when the processing of steps SA4 to SA11 explained above is repeated for the number of tracks in accordance with the depression of the transition button, the value of the counter p1 for counting the number of performance patterns belonging to the "stage A" becomes "1"; the value of counter p2 for counting the number of performance patterns belonging to the "stage B" becomes "1"; and the value of counter p3 for counting the number of performance patterns belonging to the "stage C" becomes "1" because the track Tr (1) is "Drum A", the track Tr (2) is "Bass B", the track Tr (3) is "Synth1 C", and the track Tr (4) is "Synth2 OFF".

Figure 6A:
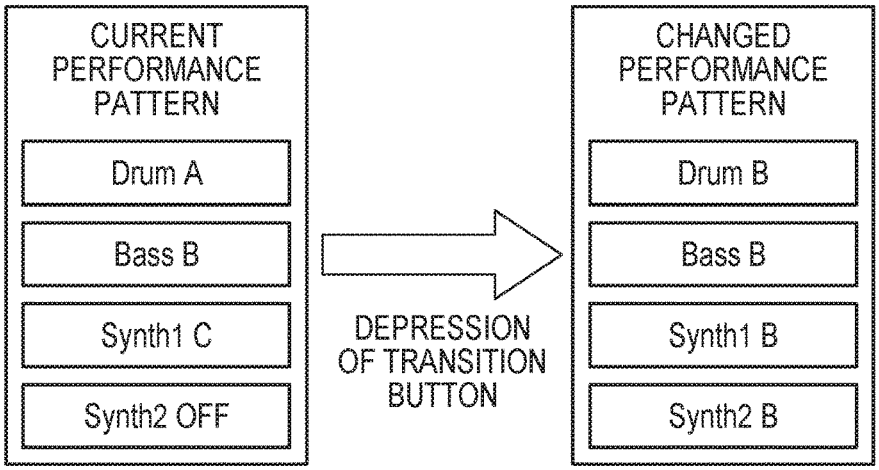
FIGS. 6A to 6C are diagrams for explaining an example of an operation of the transition button processing executed by the CPU 13.
Figure 6B:
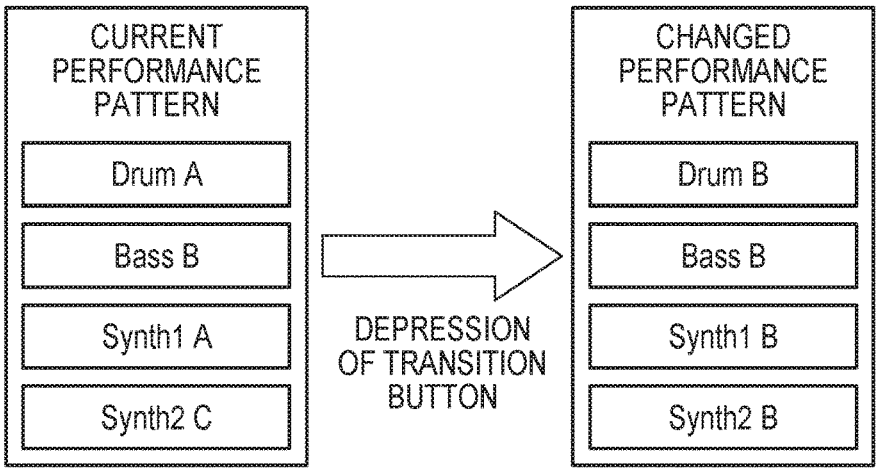

For example, the performance pattern currently selected in each of the tracks Tr (1) to (4) is considered to be the combination shown in FIG. 6B before pressing the transition button. Then, when the processing of steps SA4 to SA11 explained above is repeated for the number of tracks in accordance with the depression of the transition button, the value of the counter p1 for counting the number of performance patterns belonging to the "stage A" becomes "2"; the value of the counter p2 for counting the number of performance patterns belonging to the "stage B" becomes "1"; and the value of counter p3 for counting the number of performance patterns belonging to the "stage C" becomes "1", because the track Tr (1) is "Drum A", the track Tr (2) is "Bass B", the track Tr (3) is "Synth1 A", the track Tr (4) is "Synth2 C".

Figure 6C:
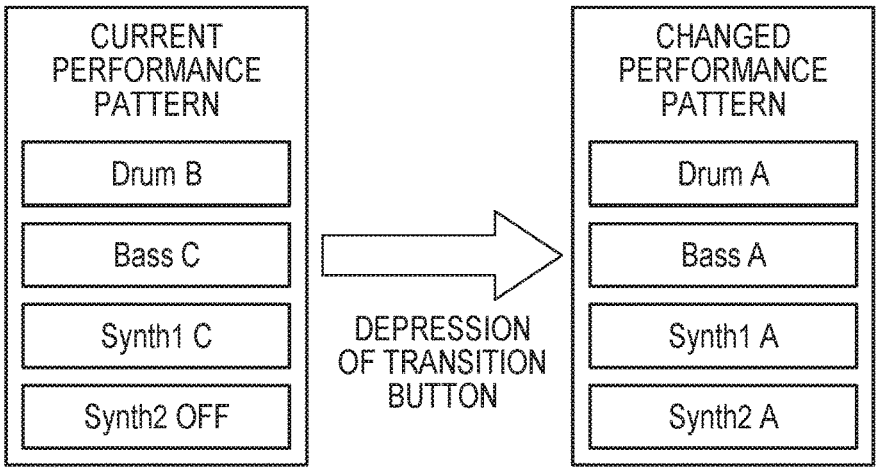

Further, for example, the performance pattern currently selected in each of the tracks Tr (1) to (4) is considered to be the combination shown in FIG. 6C before pressing the transition button. Then, when the processing of steps SA4 to SA11 explained above is repeated for the number of tracks in accordance with the depression of the transition button, the value of the counter p1 for counting the number of performance patterns belonging to the "stage A" becomes "0"; the value of the counter p2 for counting the number of performance patterns belonging to the "stage B" becomes "1"; and the value of counter p3 for counting the number of performance patterns belonging to the "stage C" becomes "2", because the track Tr (1) is "Drum B", the track Tr (2) is "Bass C", the track Tr (3) is "Synth1 C", and the track Tr (4) is "Synth2 OFF".

Further, when the number of performance patterns belonging to the "stage A", the number of performance patterns belonging to the "stage B", and the number of performance patterns belonging to the "stage C" are stored in the counters p1, p2, and p3, respectively, as a result of having determined as to which of the "stage A", the "stage B" or the "stage C" the performance pattern currently selected in each of the tracks Tr (1) to (4) belongs to as described above, the determination result of step SA11 (see FIG. 4, 5>n?) explained above is "NO", and the CPU 13 executes the pattern change processing via step SA12.

In the pattern change processing, as explained below, among the number of performance patterns belonging to the "stage A" (value of counter p1), the number of performance patterns belonging to the "stage B" (value of counter p2), and the number of performance patterns belonging to the "stage C" (value of counter p3) obtained from the currently selected performance pattern in each of the tracks Tr (1) to (4), a stage that has the maximum number of performance patterns is determined to be the "current stage", and the performance pattern of each of the tracks Tr (1) to (4) is changed to a stage subsequent to the determined "current stage". Then, when the pattern change processing is completed, the CPU 13 finishes the transition button processing.

(2) Operation of Pattern Change Processing

Figure 5:
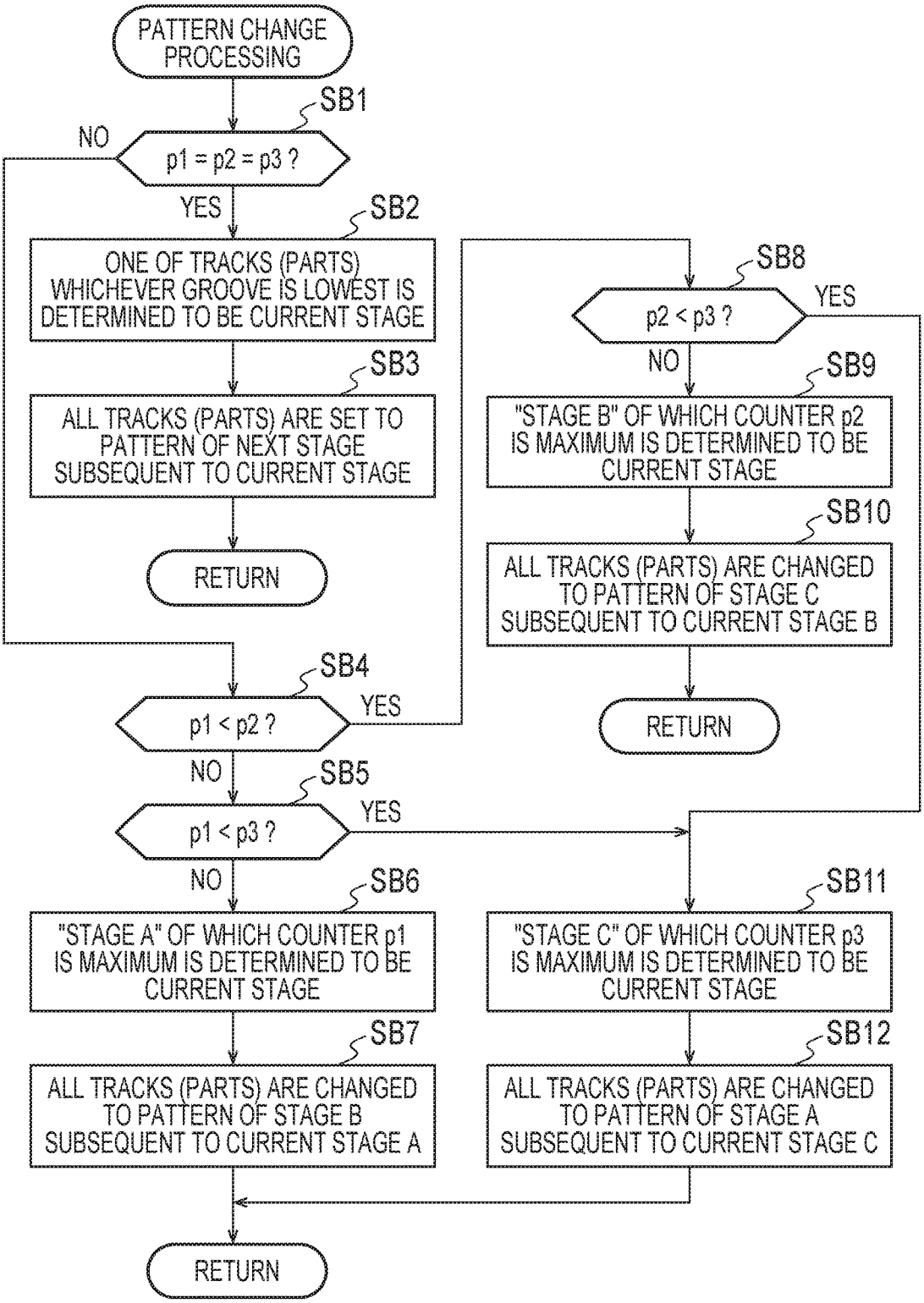
FIG. 5 is a flowchart showing an operation of pattern change processing executed by the CPU 13.

Subsequently, the operation of the pattern change processing will be described with reference to FIG. 5. FIG. 5 is a flowchart showing the operation of the pattern change processing executed by the CPU 13. When this processing is executed via step SA12 of the transition button processing explained above (see FIG. 4), the CPU 13 determines the maximum value from the obtained counters p1, p2, p3 obtained in the transition button processing in steps SB1, SB4, SB5, SB8 shown in FIG. 5. Hereinafter, the operation will be described in each of "a case where p1=p2=p3", "a case where p1 is the maximum," "a case where p2 is the maximum" and "a case where p3 is the maximum".

a. Case where p1=p2=p3

More specifically, in a case where the numbers of performance patterns belonging to the "stage A", the "stage B" and the "stage C" are the same, the determination result of step SB1 is "YES", and the CPU 13 proceeds to the processing in step SB2, and determines that one of the tracks Tr (1) to (4) whichever the groove is the lowest is determined to be the current stage. More specifically, a common stage (a commonality of the stage) is that the stage having the lowest groove is the stage A. In the other words, the common stage is determined based on current stages of the music data items which are currently played back.

More specifically, as shown in FIG. 6A, for example, where the track Tr (1) is "Drum A", the track Tr (2) is "Bass B", the track Tr (3) is "Synth1 C", and the track Tr (4) is "Synth2 OFF", then the "stage A" of which groove is the lowest is determined to be the current stage.

Then, in step SB3, the CPU 13 sets all the tracks Tr (1) to (4) to the performance pattern of the next stage subsequent to the current stage. For example, in the case of the example shown in FIG. 6A, the current stage is the "stage A", and accordingly, the CPU 13 sets all the tracks Tr (1) to (4) to the performance pattern of the subsequent stage B (another stage according to the setting), and more specifically, the CPU 13 changes the track Tr (1) to "Drum B", changes the track Tr (2) to "Bass B", changes the track Tr (3) to "Synth1 B", and changes the track Tr (4) to "Synth2 B", and then the CPU 13 terminates this processing.

b. Case where p1 is the Maximum

More specifically, in a case where the number of performance patterns belonging to the "stage A" is the maximum, the determination result of step SB1 is "NO", and the CPU 13 proceeds to step SB4. Then, in step SB4, the CPU 13 determines whether or not the value of the counter p1 is smaller than the value of the counter p2, but in this case, the determination result is "NO", and the CPU 13 proceeds to step SB5. In step SB5, the CPU 13 determines whether the value of the counter p1 is smaller than the value of the counter p3. In this case, the determination result is "NO", and the CPU 13 proceeds to step SB6.

In step SB6, the "stage A" of which counter p1 is the maximum is determined to be the current stage. More specifically, the common stage is the stage A of which stage of groove is the lowest. More specifically, as shown in FIG. 6B, for example, where the track Tr (1) is "Drum. A", the track Tr (2) is "Bass B", the track Tr (3) is "Synth1 A", and the track Tr (4) is "Synth2 C", then, the value of the counter p1 is the maximum value "2", and therefore, the "stage A" is determined as the current stage.

Then, in step SB7, the CPU 13 sets all the tracks Tr (1) to (4) to the performance pattern of the stage B (another stage according to the setting) subsequent to the current stage A. For example, in the case of the example shown in FIG. 6B, the current stage is the "stage A", and therefore, the CPU 13 sets all the tracks Tr (1) to (4) to the performance pattern of the subsequent stage B, and more specifically, the CPU 13 changes the track Tr (1) to "Drum B", changes the track Tr (2) to "Bass B", change the track Tr (3) to "Synth1 B", and changes the track Tr (4) to "Synth2 B", and then the CPU 13 terminates this processing.

c. Case where p2 is the Maximum

More specifically, in a case where the number of performance patterns belonging to the "stage B" is the maximum, the determination result of step SB1 is "NO", and the CPU 13 proceeds to step SB4. Then, in step SB4, the CPU 13 determines whether or not the value of the counter p1 is smaller than the value of the counter p2. However, in this case, the determination result is "YES", and the CPU 13 proceeds to step SB8. In step SB8, the CPU 13 determines whether or not the value of the counter p2 is smaller than the value of the counter p3. However, in this case, the determination result is "NO", and the CPU 13 proceeds to step SB9.

In step SB9, the "stage B" of which counter p2 is the maximum is determined to be the current stage. More specifically, the common stage is the stage B which is groovier than the stage A of which stage of groove is the lowest. More specifically, for example, where the track Tr (1) is "Drum. A", the track Tr (2) is "Bass B", the track Tr (3) is "Synth1 C", and the track Tr (4) is "Synth2 B", then, the value of the counter p2 is the maximum value "2", and therefore, the "stage B" is determined to be the current stage.

Then, in step SB10, the CPU 13 sets all the tracks Tr (1) to (4) to the performance pattern of the stage C subsequent to the current stage B. For example, in the case of the above example, the current stage is the "stage B", and therefore, the CPU 13 changes all the tracks Tr (1) to (4) to the performance pattern of the subsequent stage C, and more specifically, the CPU 13 changes the track Tr (1) to "Drum C", changes the track Tr (2) to "Bass C", changes the track Tr (3) to "Synth1 C", and changes the track Tr (4) to "Synth2 C", and then the CPU 13 terminates this processing.

d. Case where p3 is the Maximum

More specifically, in a case where the number of performance patterns belonging to the "stage C" is the maximum, the determination result of step SB1 is "NO", and the CPU 13 proceeds to step SB4. Then, in step SB4, the CPU 13 determines whether or not the value of the counter p1 is smaller than the value of the counter p2. In this case, the determination result is "NO", the CPU 13 proceeds to step SB5. In step SB5, the CPU 13 determines whether or not the value of the counter p1 is smaller than the value of the counter p3. However, in this case, the determination result is "YES", and the CPU 13 proceeds to step SB11.

In step SB11, the "stage C" of which counter p3 is the maximum is determined to be the current stage. The common stage is the stage C of which stage of groove is the largest. More specifically, for example, as shown in FIG. 6C, where the track Tr (1) is "Drum B", the track Tr (2) is "Bass C", the track Tr (3) is "Synth1 C", and the track Tr (4) is "Synth2 OFF", then, the value of the counter p3 is the maximum value "2", and the "stage C" is determined to be the current stage.

Then, in step SB12, the CPU 13 sets all the tracks Tr (1) to (4) to the performance pattern of the stage A subsequent to the current stage C. For example, in the case of an example shown in FIG. 6C, the current stage is the "stage C", and therefore, the CPU 13 changes all the tracks Tr (1) to (4) to the performance pattern of the subsequent stage A, and more specifically, the CPU 13 changes the track Tr (1) to "Drum A", changes the track Tr (2) to "Bass A", changes the track Tr (3) to "Synth1 A", and changes the track Tr (4) to "Synth2 A", and then the CPU 13 terminates this processing.

As described above, in this pattern change processing, among the number of performance patterns belonging to the "stage A" (the value of the counter p1), the number of performance patterns belonging to the "stage B" (the value of the counter p2), and the number of performance patterns belonging to the "stage C" (the value of the counter p3) obtained from the currently selected performance pattern in each of the tracks Tr (1) to (4), a transition that has the maximum number of performance patterns is determined to be the "current stage", and the CPU 13 determines changes the performance pattern of each of the tracks Tr (1) to (4) to the performance pattern of the stage (another stage according to the setting) subsequent to the determined "current stage".

As described above, in the present embodiment, in accordance with the depression of the transition button, which stage (transition) the performance pattern of each of the tracks Tr (1) to (4) currently selected belongs to is determined, and the number of performance patterns for each stage is obtained. Then, among the number of performance patterns for each stage obtained, the stage having the maximum number of performance patterns is determined to be the "current stage", and the performance pattern of each of the tracks Tr (1) to (4) is changed to the stage subsequent to the determined "current stage", and therefore, the performance pattern can be changed into a performance pattern making a musically natural transition. As a result, even a beginner user being poor in music knowledge can set an appropriate performance pattern matching the transition of the song.

C. Second Embodiment

Subsequently, the second embodiment will be described. Since the configuration of the second embodiment is the same as that of the first embodiment described above, description thereabout is omitted. In the following explanation, the performance pattern according to the second embodiment, which is different from the first embodiment, and the operation of the transition button processing (including pattern change processing) according to the second embodiment will be explained.

(1) Performance Pattern According to Second Embodiment

Figure 7:
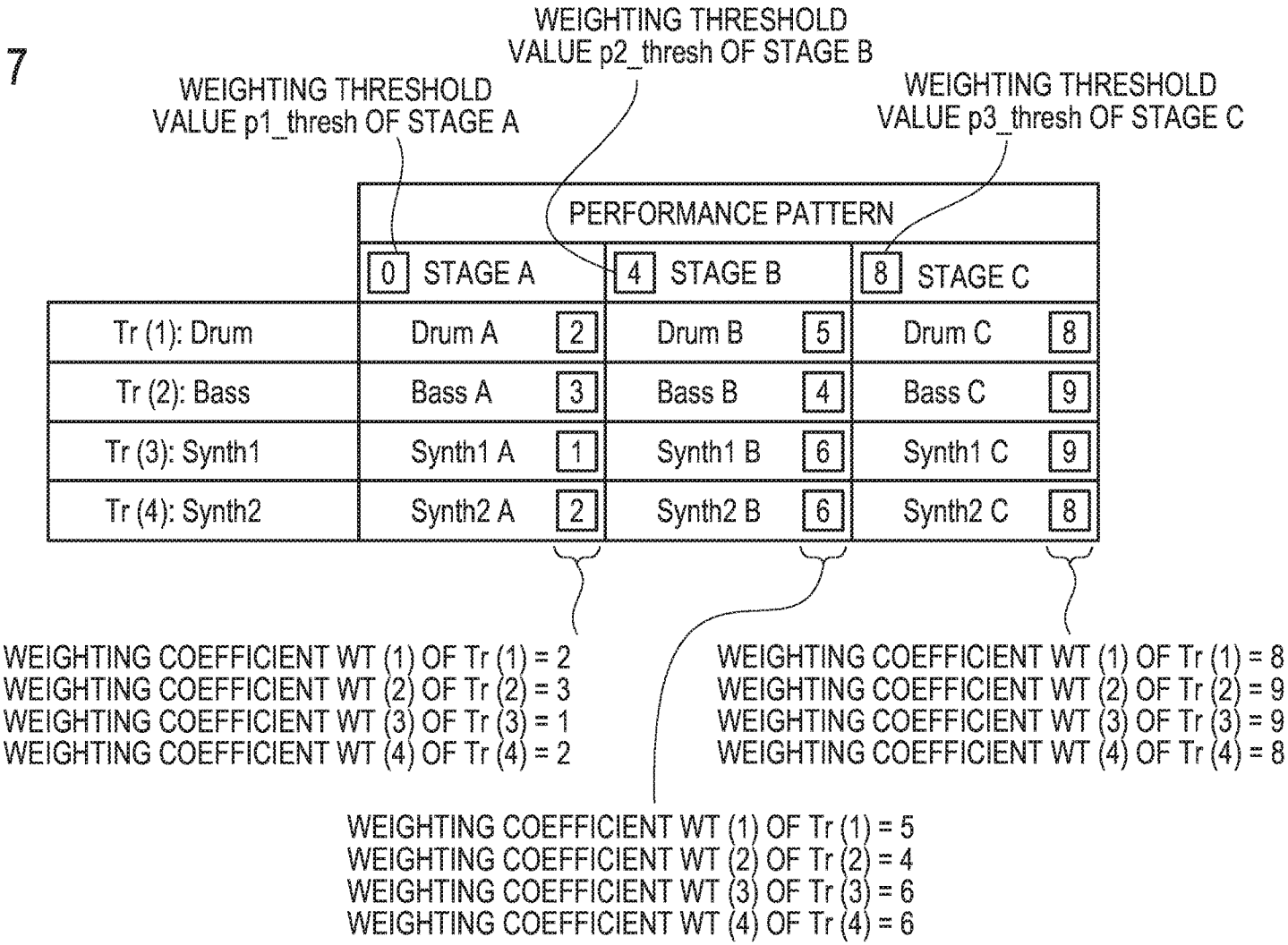
FIG. 7 is a diagram showing a transition configuration of performance pattern of each track according to a second embodiment.

FIG. 7 is a diagram showing a stage configuration of performance pattern of each track according to the second embodiment. Like the first embodiment explained above, the performance pattern shown in this figure changes according to a musically natural transition (stage A, stage B, and then stage C), and is assigned to each of the tracks Tr (1) to (4) associated with the performance part (musical instrument part). The performance pattern is different from that of the first embodiment explained above in that the performance patter includes weighting threshold values p1_thresh to p3_thresh given to the stages A to C, respectively, and weighting coefficients WT (1) to (4) given to each part (track Tr) of the stages A to C.

Hereinafter, the weighting threshold values p1_thresh to p3_thresh given to the stages A to C, respectively, of the performance pattern and the weighting coefficients WT (1) to (4) given to each track Tr (performance part) of the stages A to C will be explained with reference to FIG. 7. For example, in the performance pattern of stage A shown in FIG. 7, the weighting coefficient WT (1) of "2" is given to "Drum A" of the track Tr (1), and the weighting coefficient WT (2) of "3" is given to "Bass A" of the track Tr (2), the weighting coefficient WT (3) of "1" is given to "Synth1 A" of the track Tr (3), and the weighting coefficient WT (4) of "2" is given to "Synth2 A" of the track Tr (4).

The weighting coefficients WT (1) to WT (4) assigned to each track Tr represent the importance of the part in the performance pattern of the corresponding stage. Therefore, as the stage progresses, the importance of the part in the performance pattern changes, so if the stage is different even though the part is the same, the weighting coefficient WT will be different. For example, in the drum part of the track Tr (1), the weighting coefficient WT (1) of "2" is given to "Drum A" of the stage A, the weighting coefficient WT (1) of "5" is given to "Drum B" of the stage B, and the weighting coefficient WT (1) of "8" is given to "Drum C" of the stage C.

As shown in FIG. 7, the weighting threshold value p1_thresh is given to the stage A of the performance pattern, the weighting threshold value p2_thresh is given to the stage B, and the weighting threshold value p3_thresh is given to the stage C. These weighting threshold values p1_thresh, p2_thresh, p3_thresh are used as threshold values for determining the stage of the currently selected performance pattern in each of the tracks Tr (1) to (4).

More specifically, in the transition button processing explained below, the weighting average value calculated based on the weighting coefficients WT (1) to WT (4) of the currently selected performance pattern in each of the tracks Tr (1) to (4) is less than the weighting threshold value p2_thresh, the current stage is determined to be the "stage A" (the common stage is the stage A of which stage of groove is the lowest), and when the weighting average value calculated based on the weighting coefficients WT (1) to WT (4) of the currently selected performance pattern in each of the tracks Tr (1) to (4) is equal to or more than the weighting threshold value p2_thresh and is less than the weighting threshold value p3_thresh, the current stage is determined to be the "stage B" (the common stage is the stage B which is groovier than the stage A of which stage of groove is the lowest), and when the weighting average value calculated based on the weighting coefficients WT (1) to WT (4) of the currently selected performance pattern in each of the tracks Tr (1) to (4) is equal to or more than the weighting threshold value p3_thresh, the current stage is determined to be the "stage C" (the common stage is the stage C of which stage of groove is the largest).

Figure 8:
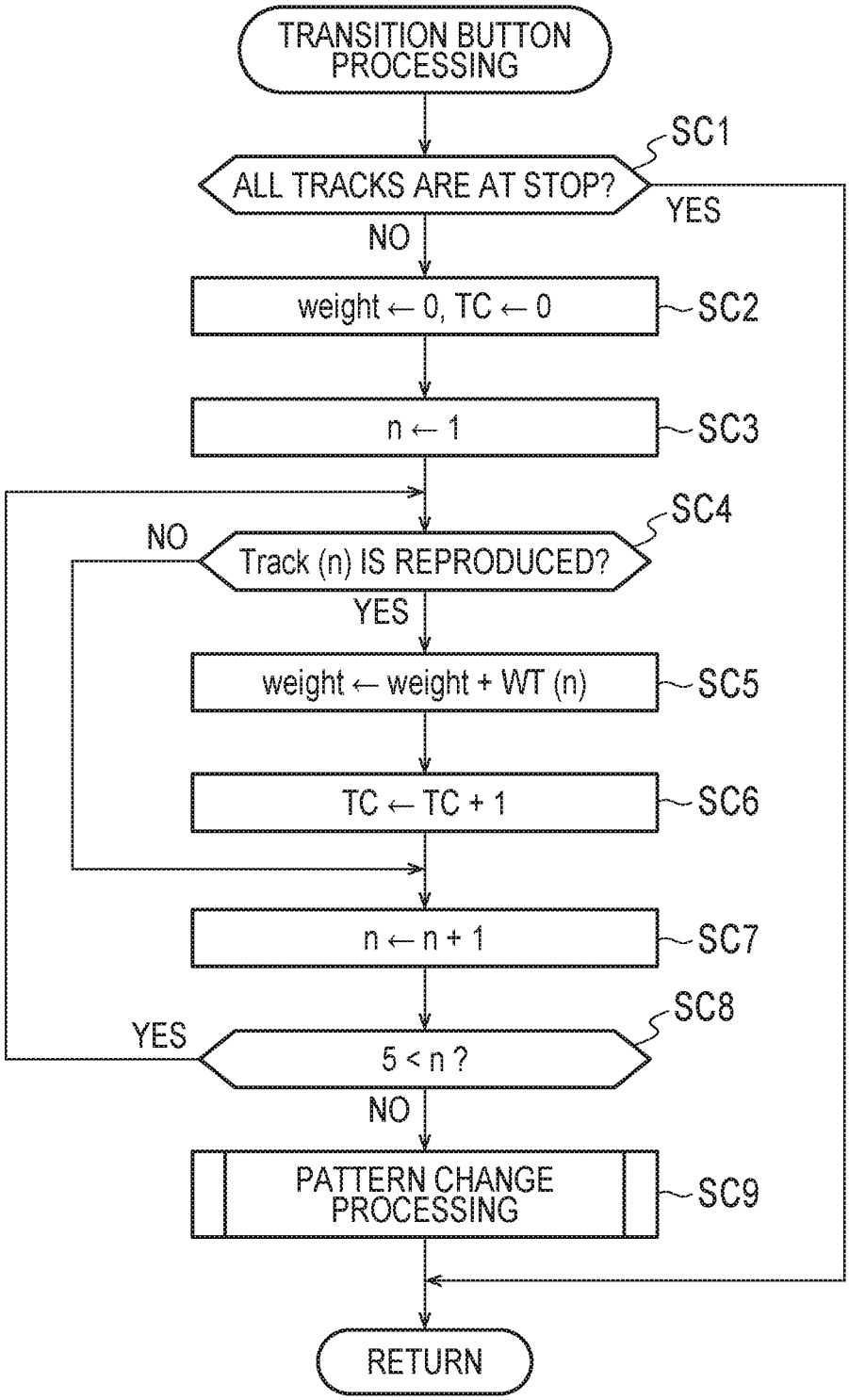
FIG. 8 is a flowchart showing an operation of transition button processing according to the second embodiment executed by the CPU 13.

(2) Operation of Transition Button Processing According to the Second Embodiment Subsequently, the operation of the transition button processing according to the second embodiment will be explained. FIG. 8 is a flowchart showing the operation of the transition button processing according to the second embodiment executed by the CPU 13. Like the first embodiment explained above, when the transition button (not shown) disposed in the operation unit 11 is pressed by the user in the state where the electronic musical instrument 100 is in the ON state, the CPU 13 executes the transition button processing shown in FIG. 8 according to the operation event, and proceeds to the processing in step SC1.

In step SC1, the CPU 13 determines whether or not all tracks Tr (1) to (4) are at a stop, i.e., whether or not automatic performance is at a stop. If all tracks Tr (1) to (4) are at a stop (the automatic performance is at a stop), the determination result is "YES" and this processing is terminated, but if the automatic performance is not at a stop, the determination result is "NO" and the CPU 13 proceeds to the processing in next step SC2.

In step SC2, the CPU 13 resets the register weight for accumulating the weighting coefficients WT (1) to WT (4) for each track Tr (for each part) and the counter TC for counting the number of tracks to zero, and in step SC3 subsequent thereto, the CPU 13 sets the initial value "1" to the pointer n designating the track.

Then, in step SC4, the CPU 13 determines whether or not the track Tr (n) designated by the pointer n is being played back, and more specifically, the CPU 13 determines whether the performance pattern is selected. When the performance pattern is not selected, and the track Tr (n) designated by the pointer n is not being played back, the determination result in this case is "NO", and the CPU 13 proceeds to step SC7 explained later. In contrast, when the performance pattern is selected for the part of the track Tr (n) designated by the pointer n and it is being played back, the determination result of step SC4 is "YES", and the CPU 13 proceeds to next step SC5.

In step SC5, the CPU 13 accumulates, in the register weight, the weighting coefficient WT (n) assigned to the performance pattern of the track Tr (n) designated by the pointer n. Subsequently, the CPU 13 proceeds to step SC6, increments the counter TC to increment the number of tracks counted. Subsequently, the CPU 13 proceeds to step SC7, to increment the pointer n.

Subsequently, in step SC8, the CPU 13 determines whether or not the value of the incremented pointer n is smaller than "5", and more specifically, in the tracks Tr (1) to (4), the weighting coefficient WT of the track Tr for which the performance pattern is selected is accumulated in the register weight, and the CPU 13 determines whether or not the number of tracks Tr has been counted with the counter TC. When the value of incremented pointer n is less than "5", and the weighting coefficient WT is accumulated in the register weight and the number of tracks Tr has not yet been counted with the counter TC, then, the determination result is "YES", and the CPU 13 returns back to the processing in step SC4.

Thereafter, the CPU 13 repeatedly executes the above steps SC4 to SC8 until the value of the incremented pointer n attains "5", and counts the number of tracks Tr with the counter TC while accumulating, in the register weight, the weighting coefficient WT of the track Tr of the tracks Tr (1) to (4) for which the performance pattern is selected.

Hereinafter, a specific example of an operation of steps SC4 to SC8 will be described based on the example shown in FIGS. 10A to 10B. Now, for example, before the transition button is depressed, the currently selected performance pattern in each of the tracks Tr (1) to (4) is considered to be in a combination shown in FIG. 10A. More specifically, the track Tr (1) is considered to be "Drum A" attached with the weighting coefficient WT (1) of "2", the track Tr (2) is considered to be "Bass B" attached with the weighting coefficient WT (2) of "4", the track Tr (3) is considered to be "Synth1 A" attached with the weighting coefficient WT (3) of "1", and the track Tr (4) is considered to be "Synth2 C" attached with the weighting coefficient WT (4) of "8".

Then, when the processing of steps SC4 to SC8 explained above is repeated for the number of tracks in accordance with the depression of the transition button, then the CPU 13 stores, in the register weight, a value "15" obtained by accumulating the weighting coefficients WT (1) to (4) of the tracks Tr (1) to (4) in this case, and stores the number of tracks Tr "4" into the counter TC.

Figure 10A:
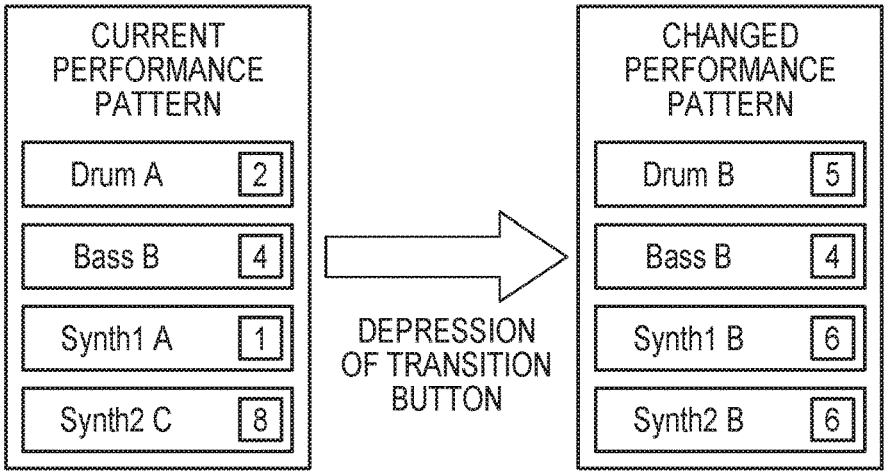
FIGS. 10A to 10C are diagrams for explaining an example of an operation of transition button processing according to the second embodiment executed by the CPU 13.
Figure 10B:
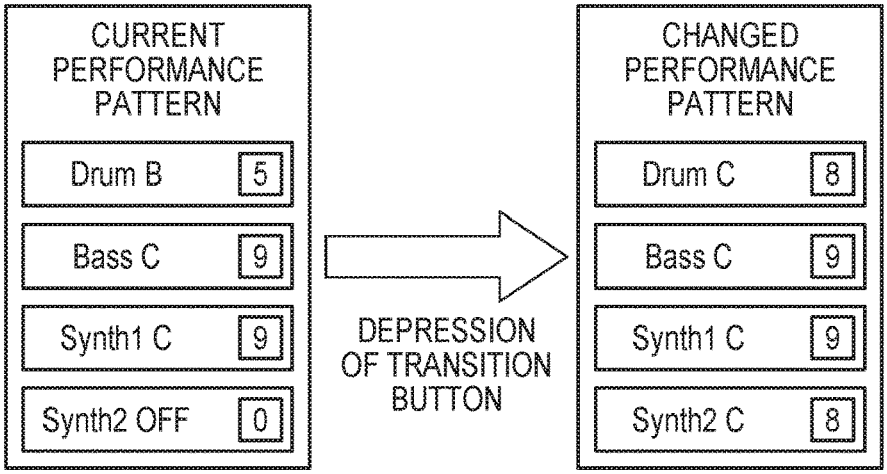

For example, before the transition button is depressed, the currently selected performance pattern in each of the tracks Tr (1) to (4) is considered to be, as shown in FIG. 10B, as follows: the currently selected performance pattern in the track Tr (1) is "Drum B" given with the weighting coefficient WT (1) of "5", the currently selected performance pattern in the track Tr (2) is "Bass C" given with the weighting coefficient WT (2) of "9", the currently selected performance pattern in the track Tr (3) is "Synth1 C" given with the weighting coefficient WT (3) of "9", and the currently selected performance pattern in the track Tr (4) is "Synth1OFF" given with the weighting coefficient WT (4) of "0".

Then, when the CPU 13 repeatedly executes the above steps SC4 to SC8 for the number of tracks in accordance with the depression of the transition button, the CPU 13 stores, in the register weight, a value 23 obtained by accumulating the weighting coefficients WT (1) to (4) of the tracks Tr (1) to (4) in this case, and stores the number of tracks Tr "4" to the counter TC. In this manner, the accumulation value weight of weighting coefficients WT (1) to (4) and the number of tracks Tr TC are obtained, and when the value of the incremented pointer n attains "5", the determination result of step SC8 shown in FIG. 8 is "NO", and the CPU 13 executes the pattern change processing according to the second embodiment via step SC9.

In the pattern change processing according to the second embodiment, as explained later, the current stage is determined in accordance with which of the three cases the weighting average value WA calculated based on the weighting coefficients WT (1) to WT (4) of the currently selected performance pattern in each of the tracks Tr (1) to (4) corresponds to, and more specifically, the current stage is determined in accordance with whether: the weighting average value WA calculated based on the weighting coefficients WT (1) to WT (4) of the currently selected performance pattern in each of the tracks Tr (1) to (4) is less than the weighting threshold value p2_thresh; the weighting average value WA calculated based on the weighting coefficients WT (1) to WT (4) of the currently selected performance pattern in each of the tracks Tr (1) to (4) is equal to or more than the weighting threshold value p2_thresh and is less than the weighting threshold value p3_thresh; and the weighting average value WA calculated based on the weighting coefficients WT (1) to WT (4) of the currently selected performance pattern in each of the tracks Tr (1) to (4) is equal to or more than the weighting threshold value p3_thresh, and all the tracks Tr (1) to (4) are changed to a performance pattern of the stage subsequent to the current stage (another stage according to the setting).

(2) Operation of Pattern Change Processing According to Second Embodiment

Figure 9:
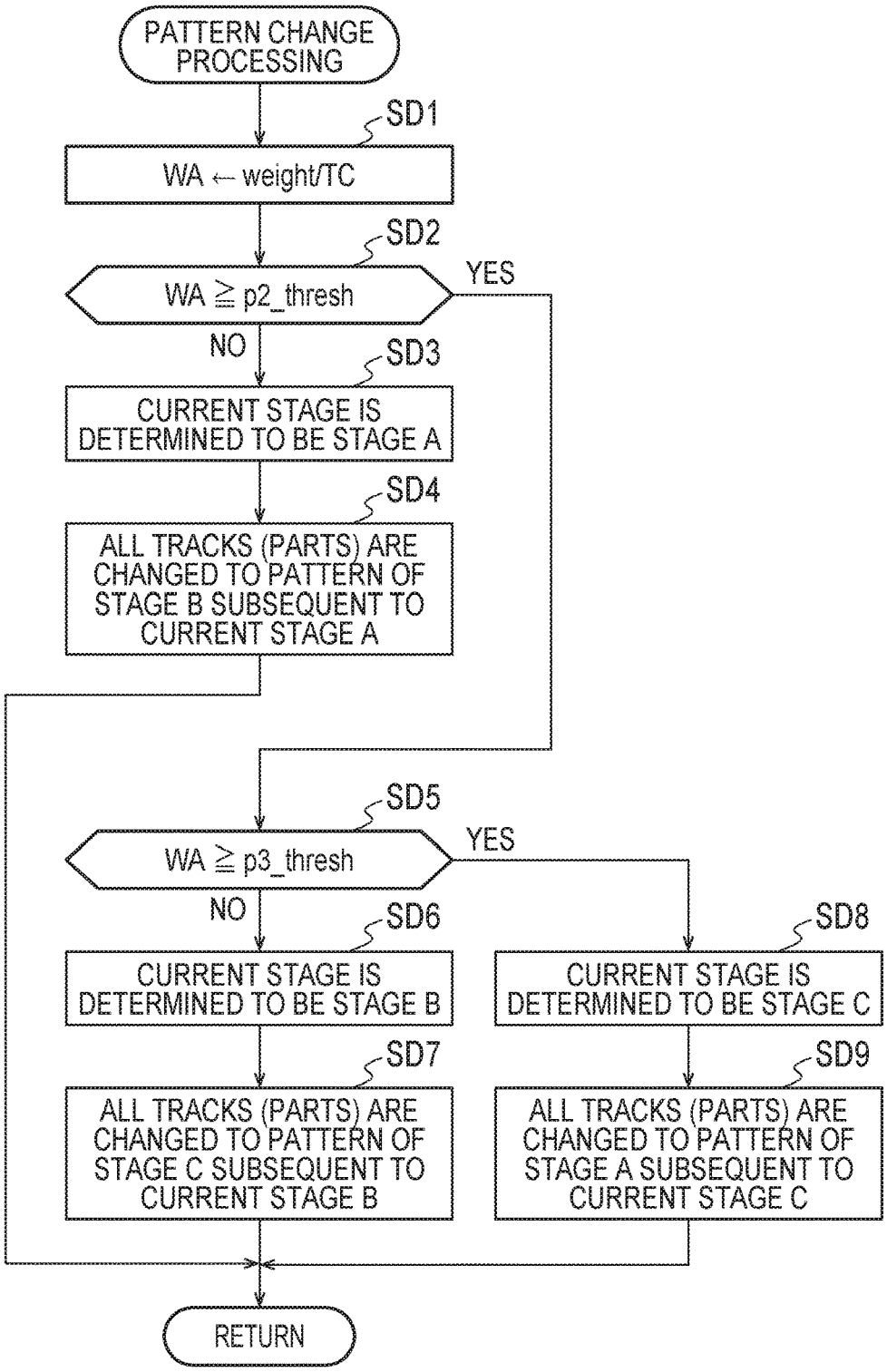
FIG. 9 is a flowchart showing an operation of pattern change processing according to the second embodiment executed by the CPU 13.

Subsequently, the operation of the pattern change processing according to the second embodiment will be explained. FIG. 9 is a flowchart showing an operation of pattern change processing according to the second embodiment executed by the CPU 13. When this processing is executed via step SC 9 (see FIG. 8) of the above-described transition button processing, the CPU 13 proceeds to the processing in step SD1 shown in FIG. 9, and calculates the weighting average value WA by dividing the accumulation value of the weighting coefficients WT (1) to (4) stored in the register weight by the number of tracks Tr stored in the counter TC. This weighting average value WA serves as an index indicating the stage of the currently selected performance pattern in each of the tracks Tr (1) to (4).

Subsequently, the CPU 13 proceeds to step SD2 to determine whether or not the weighting average value WA serving as the index representing the stage of the currently selected performance pattern in each of the tracks Tr (1) to (4) is equal to or more than a value "4" of the weighting threshold value p2_thresh of the stage B. When the weighting average value WA is less than the weighting threshold value p2_thresh of the stage B, the determination result is "NO", and the CPU 13 proceeds to step SD3. In step SD3, the CPU 13 determines that the stage of the currently selected performance pattern in each of the tracks Tr (1) to (4) is the "stage A". In step SD4 subsequent thereto, the CPU 13 changes all the tracks Tr (1) to (4) to the performance pattern of the "stage B" subsequent to the current "stage A", and terminates this processing.

More specifically, when the currently selected performance pattern in each of the tracks Tr (1) to (4) is, for example, in a combination as shown in FIG. 10A, the weighting average value WA is (2+4+1+8)/4="3.75", which is less than the weighting threshold value p2_thresh of the stage B, and therefore, the current stage is determined to be the "stage A", and changes the performance pattern to a performance pattern of the "stage B" subsequent thereto.

On the other hand, when the weighting average value WA is equal to or more than the weighting threshold value p2_thresh of the stage B, the determination result of the step SD2 is "NO" and the CPU 13 proceeds to the processing in step SD5, and determines whether or not the weighting average value WA is equal to or more than a value "8" of the weighting threshold value p3_thresh of the stage C. When the weighting average value WA is less than the weighting threshold value p3_thresh of the stage C, the determination result is "NO", and the CPU 13 proceeds to step SD6. In step SD6, the CPU 13 determines that the stage of the currently selected performance pattern in each of the tracks Tr (1) to (4) is the "stage B", and in step SD 7 subsequent thereto, the CPU 13 changes all the tracks Tr (1) to (4) to the performance pattern of the "stage C" subsequent to the current "stage B", and terminates this processing.

More specifically, when the currently selected performance pattern of each of the tracks Tr (1) to (4) is, for example, in the combination as shown in FIG. 10B, the weighting average value WA is (5+9+9+0)/4="5.75", which is less than the weighting threshold value p3_thresh of the stage C, and therefore, the CPU 13 determines that the current stage is the "stage B", and changes the performance pattern to a performance pattern of the "stage C" subsequent thereto.

In contrast, when the weighting average value WA is equal to or more than the weighting threshold value p3_thresh of the stage C, the determination result of step SD5 explained above is "YES", and the CPU 13 proceeds to the processing in step SD8, and determines that the stage of the currently selected performance pattern in each of the tracks Tr (1) to (4) is the "stage C", and in step SD9 subsequent thereto, the CPU 13 changes all the tracks Tr (1) to (4) to the performance pattern of the "stage A" subsequent to the current "stage C", and terminates this processing.

As described above, in the pattern change processing according to the second embodiment, when the weighting average value WA (weight/TC) calculated based on the weighting coefficients WT (1) to WT (4) of the currently selected performance pattern of each of the tracks Tr (1) to (4) is less than the weighting threshold value p2_thresh, the current stage is determined to be the "stage A", and all the tracks Tr (1) to (4) are changed to the performance pattern of the "stage B" subsequent to the current "stage A". When the weighting average value WA (weight/TC) is equal to or more than the weighting threshold value p2_thresh and less than the weighting threshold value p3_thresh, the current stage is determined to be the "stage B", all the tracks Tr (1) to (4) are changed to the performance pattern of the "stage C" subsequent to the current "stage B". Further, the weighting average value WA (weight/TC) is equal to or more than the weighting threshold value p3_thresh, the current stage is determined to be the "stage C", and all the tracks Tr (1) to (4) are changed to the performance pattern of the "stage A" subsequent to the current "stage C".

As described above, in the second embodiment, the weighting coefficients WT (1) to (4) are given to the performance patterns of the stages A to C assigned to each of the tracks Tr (1) to (4) associated with the performance part (musical instrument part), and the weighting threshold values p1_thresh to p3_thresh are given for the stages A to C, respectively, and in accordance with depression of the transition button, the current stage is determined by determining which threshold value of the weighting threshold values p1_thresh to p3_thresh for the stages A to C the weighting average value WA (weight/TC) calculated based on the weighting coefficients WT (1) to WT (4) of the currently selected performance pattern in each of the tracks Tr (1) to (4) falls in, and accordingly, all the tracks Tr (1) to (4) are changed to the performance pattern of the stage subsequent to the current stage, and therefore, the performance pattern can be changed to a performance pattern making a musically natural stage. As a result, even a beginner user being poor in music knowledge can set an appropriate performance pattern matching the stage (transition) of the song.

Figure 10C:
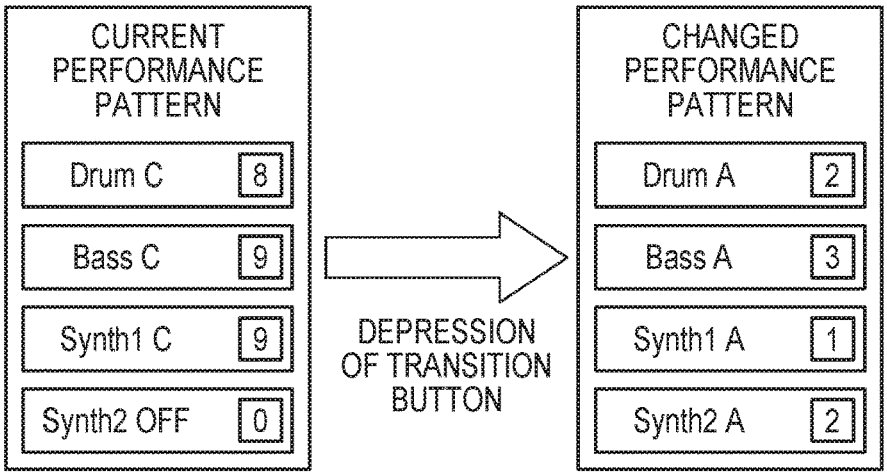

In the second embodiment explained above, for example, just like an example shown in FIG. 10B, the weighting average value WA (weight/TC) is calculated while the weighting coefficient WT (4) of the track Tr (4) in the OFF state in which the performance pattern is not selected is assumed to be zero, but instead of this, the track Tr in the OFF state in which the performance pattern is not selected may be omitted from the calculation of the weighting average value WA (weight/TC). For example, in the example as shown in FIG. 10C, the track Tr (4) in the OFF state is excluded from the calculation target, and the weighting average value WA is (8+9+9)/3="8.67", which is equal to or more than the weighting threshold value p3_thresh of the stage C, and therefore, the current stage is determined to be the "stage C", and all the tracks Tr (1) to (4) are changed to the performance pattern of the subsequent "stage A". Even in this case, the performance pattern can be changed into a performance pattern making a musically natural stage (transition).

In the first and second embodiments explained above, for example, four tracks (a drum part, a base part, a synth 1 part, and a synth 2 part) are assigned to the twelve white keys included in the keyboard musical instrument. Three stages achieving different levels of grooves (stage A, stage B which is groovier than stage A, and stage C which is groovier than stage B) are allocated to the tracks. In other words, one of the three stages in any one of the four tracks is assigned to one white key. For example, when the user depresses the white key to which the stage A of the drum part is assigned, the pattern phrase of the stage A of the drum part is played back. If a black key functioning as a transition button is depressed by the user while the keyboard musical instrument is reproducing the stage A of the drum part, the stage B of the base part, the stage A of the synth 1 part, and the stage C of the synth 2 part based on the key depression by the user, the processor determines that the current stage (stage commonality) is the stage A, so that the pattern phrase of stage B which is the next stage of the stage A is played back in each part. More specifically, in the drum part, the stage to be played back is switched from the stages A to the pattern phrase of the stage B, and in the base part, the stage to be played back continues to be the pattern phrase of the stage B and is not switched, and in the synth 1 part, the stage to be played back is switched from the stages A to the pattern phrase of the stage B, and in the synth 2 part, the stage to be played back is switched from the stage C to the pattern phrase of the stage B. The above embodiment has been explained with the example in which four tracks are assigned to twelve white keys, and three stages are assigned to one track, but the number of as signed tracks is not limited to four. Three, five, or any number of tracks may be assigned. Similarly, the number of assigned stages is not limited to three. Four, five, or any number of stages may be assigned.

In the first and second embodiments explained above, in order to simplify the explanation, the performance pattern is configured to be changed into a performance pattern making a musically natural transition immediately in accordance with depression of the transition button, but the embodiments are not limited thereto, and in accordance with depression of the transition button, the pattern can be changed at an appropriate musical time, for example, the pattern can be changed at a beat of a performance pattern or the pattern can be changed when a predetermined measure has elapsed, and in such cases, the performance pattern can be changed into a performance pattern making a more musically natural transition.

In addition, in the first and second embodiments explained above, the transition button processing is executed in accordance with depression of the transition button, but instead of this, for example, in a case where, in the tracks Tr (1) to (4), two or more performance patterns are replaced according to user operation, the transition button processing may be configured to be executed automatically. In this case, when, for example, a beginner user and the like does not know how to switch the performance pattern in accordance with the stage (transition) of the song, the performance pattern can be automatically changed into a performance pattern making a musically natural stage (transition).

In addition, the present application is not limited to the above-described embodiments, and various modifications can be made in the implementation stage without departing from the gist thereof. Functions to be executed in the above-described embodiments may be implemented in combination as appropriate as much as possible. The above-described embodiments include various stages, and various inventions can be extracted by appropriately combining the plurality of disclosed configuration requirements. Even if some configuration requirements are deleted from all configuration requirements shown in, for example, the embodiments, a configuration from which this configuration requirement has been deleted can be extracted as an invention if the effects can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A performance apparatus comprising:

a plurality of keys that are assigned respective music data items for performing a piece of music including plural tracks, wherein each track corresponds to a part of the piece of music performed by one instrument among plural instruments, the music data items are divided into track groups, each track group corresponds to a respective one of the plural tracks and includes plural stages, each stage corresponds to a respective different pattern performed by the one instrument corresponding to the track group to which the stage belongs, and each of the music data items is associated with an index indicating the stage of the track group to which the music data item belongs; and a processor;

wherein the processor executes:

play back processing that plays back, based on a user designation, music data items of each of the track groups at the same time, with the music data item of only one of the stages in each of the track groups being played back at the same time;

determination processing that determines a common stage based on current stages of the music data items which are currently being played back in the play back processing; and change processing that (1) changes each of the current stages into a next stage following the common stage determined in the determination processing, and (2) changes the music data items played back in the play back processing into the music data items corresponding to the next stage for each of the track groups, and wherein in executing the change processing, when a current stage of at least one of the music data items which are currently being played back in the play back processing is equal to the next stage, the current stage of the at least one of the music data items is not changed.

2. The performance apparatus according to claim 1, wherein:

the common stage is obtained based on the indices associated with all of the music data items which are currently being played back;

the determination processing determines an index appearing most frequently among the indices associated with all of the music data items which are currently being played back as an index indicating the current stage; and the change processing changes the music data items which are currently being played back into music data items having transitioned from their current stage into another stage.

3. The performance apparatus according to claim 1, wherein:

the common stage is obtained based on a weighting average value calculated by averaging predetermined weighting coefficients assigned to the music data items which are currently being played back;

the determination processing determines the current stage based on the calculated weighting average value; and the change processing changes the music data items which are currently being played back into music data items having transitioned from their current stage into another stage.

4. An electronic musical instrument comprising:

the performance apparatus according to claim 1; and a speaker for outputting the music data items processed by the performance apparatus.

5. A performance method for a performance apparatus including a processor and a plurality of keys that are assigned respective music data items for performing a piece of music including plural tracks, wherein each track corresponds to a part of the piece of music performed by one instrument among plural instruments, the music data items are divided into track groups, each track group corresponds to a respective one of the plural tracks and includes plural stages, each stage corresponds to a respective different pattern performed by the one instrument corresponding to the track group to which the stage belongs, and each of the music data items is associated with an index indicating the stage of the track group to which the music data item belongs, the method comprising:

a step of playing back, based on a user designation, music data items of each of the track groups at the same time, with the music data item of only one of the stages in each of the track groups being played back at the same time;

a step of determining a common stage based on current stages of the music data items which are currently being played back in the step of playing back; and a step of (1) changing each of the current stages into a next stage following the common stage determined in the step of determining, and (2) changing the music data items played back in the step of playing back into the music data items corresponding to the next stage for each of the track groups, wherein in the step of changing, when a current stage of at least one of the music data items which are currently being played back in the step of playing back is equal to the next stage, the current stage of the at least one of the music data items is not changed.

6. The performance method according to claim 5, wherein:

the common stage is obtained based on the indices associated with all of the music data items which are currently being played back;

in the step of determining, an index appearing most frequently among the indices associated with all of the music data items which are currently being played back is determined to be an index indicating the current stage; and in the step of changing, the music data items which are currently being played back are changed into music data items having transitioned from theft current stage into another stage.

7. The performance method according to claim 5, wherein:

the common stage is obtained based on a weighting average value calculated by averaging predetermined weighting coefficients assigned to the music data items which are currently being played back;

in the step of determining, the current stage is determined based on the calculated weighting average value; and in the step of changing, the music data items which are currently being played back are changed into music data items having transitioned from theft current stage into another stage.

8. A non-transitory computer-readable storage medium having stored thereon a program executable by a processor of a performance apparatus, the performance apparatus including a plurality of keys that are assigned respective music data items for performing a piece of music including plural tracks, wherein each track corresponds to a part of the piece of music performed by one instrument among plural instruments, the music data items are divided into track groups, each track group corresponds to a respective one of the plural tracks and includes plural stages, each stage corresponds to a respective different pattern performed by the one instrument corresponding to the track group to which the stage belongs, and each of the music data items is associated with an index indicating the stage of the track group to which the music data item belongs, the program controlling the performance apparatus to execute processing comprising:

play back processing that plays back, based on a user designation, music data items of each of the track groups at the same time, with the music data item of only one of the stages in each of the track groups being played back at the same time;

determining determination processing that determines a common stage based on current stages of the music data items which are currently being played back in the play back processing; and change processing that (1) changes each of the current stages into a next stage following the common stage determined in the determination processing, and (2) changing the music data items played back in the play back processing into the music data items corresponding to the next stage for each of the track groups, wherein in executing the change processing, when a current stage of at least one of the music data items which are currently being played back in the play back processing is equal to the next stage, the current stage of the at least one of the music data items is not changed.

9. The non-transitory computer-readable storage medium according to claim 8, wherein:

the common stage is obtained based on the indices associated with all of the music data items which are currently being played back;

the determination processing determines an index appearing most frequently among the indices associated with all of the music data items which are currently being played back as an index indicating the current stage; and the change processing changes the music data items which are currently being played back into music data items having transitioned from their current stage into another stage.

10. The non-transitory computer-readable storage medium according to claim 8, wherein:

the common stage is obtained based on a weighting average value calculated by averaging predetermined weighting coefficients assigned to the music data items which are currently being played back;

the determination processing determines the current stage based on the calculated weighting average value; and the change processing changes the musical data items which are currently being played back into musical data items having transitioned from their current stage into another stage.

* * * * *